US006101424A

United States Patent [19]

Sawada

[11] Patent Number: 6,101,424

[45] Date of Patent: Aug. 8, 2000

[54] METHOD FOR MANUFACTURING FOUNDATION GARMENT

[75] Inventor: Hiroshi Sawada, Toyama-ken, Japan

[73] Assignee: New Lady Co., Ltd., Toyama-ken, Japan

[21] Appl. No.: 08/956,169

[22] Filed: Oct. 22, 1997

[30] Foreign Application Priority Data

Oct. 24, 1996 [JP] Japan ..... 8-282719

[51] Int. Cl.[7] ..... G06F 19/00; G06G 1/14; G06G 1/16

[52] U.S. Cl. ..... 700/136; 700/132; 700/83; 700/128; 700/134

[58] Field of Search ..... 364/470.03, 470.07, 364/188, 470.02, 470.05; 700/132, 136, 83, 128, 134

[56] References Cited

U.S. PATENT DOCUMENTS

| | | | |
|---|---|---|---|
| 4,149,246 | 4/1979 | Goldman | 364/917 |
| 4,414,621 | 11/1983 | Bown et al. | 364/188 |
| 4,546,434 | 10/1985 | Gioello | 364/400 |
| 5,163,006 | 11/1992 | Deziel | 364/470 |
| 5,206,804 | 4/1993 | Thies et al. | 364/401 |
| 5,495,568 | 2/1996 | Beavin | 395/161 |
| 5,515,168 | 5/1996 | Dudkiewicz | 356/376 |
| 5,530,652 | 6/1996 | Croyle et al. | 700/130 |
| 5,537,946 | 7/1996 | Sadeh et al. | 112/470.07 |
| 5,548,006 | 8/1996 | Park et al. | 364/470.06 |
| 5,548,519 | 8/1996 | Park et al. | 364/470.06 |
| 5,663,885 | 9/1997 | Stahl | 364/470.05 |
| 5,757,950 | 5/1998 | Bruder | 382/111 |

FOREIGN PATENT DOCUMENTS

| | | |
|---|---|---|
| 0 227 642 A2 | 7/1987 | European Pat. Off. . |
| 0 305 107 A2 | 3/1989 | European Pat. Off. . |
| 0 524 119 B1 | 1/1993 | European Pat. Off. . |
| 0 554 647 A1 | 8/1993 | European Pat. Off. . |
| 2 677 151 A1 | 12/1992 | France . |
| 2 679 327 A1 | 1/1993 | France . |
| 59-180411 | 10/1984 | Japan . |
| 61-44306 | 3/1986 | Japan . |
| 64-34329 | 2/1989 | Japan . |
| 1-121707 | 5/1989 | Japan . |
| 6-243201 | 9/1994 | Japan . |

OTHER PUBLICATIONS

"Gazette of Japanese Patent Laid —Open No. Hei 6–243201" (Translation), 1994.

"Jidoka Gijutsu (Automation Technology) vol. 26, No. 10, pp. 56–62", 1995.

Horiguchi "Sensors for Measuring Shape"–Jidoka Gijutsu ( Automation Technology) –vol. 26, No. 10, pp. 56–62.

*Primary Examiner*—William Grant
*Assistant Examiner*—Iván Calcaño
*Attorney, Agent, or Firm*—Armstrong, Westerman, Hattori, McLeland & Naugthon

[57] ABSTRACT

Models of varying body forms are measured in three dimension, both in nude and wearing suitable foundation garment to form a data base. The customer is measured in three dimension both in nude and in foundation garment. A portion of the customer's body is identified, and a model data most closely resembling the customer's data for said portion is selected. The selected model data is then adjusted for differences in height, inclination, cross sections at varying elevations, and for continuity at the ends of the portion. A pattern is made from the adjusted model data, cloth is cut using the pattern and sewn together to obtain the foundation garment.

5 Claims, 14 Drawing Sheets

METHOD FOR MANUFACTURING FOUNDATION GARMENT

BACKGROUND OF THE INVENTION

1. Field of the Invention

This invention relates to a method for manufacturing foundation garment, and more particularly a method for manufacturing foundation garment against an order placed by a customer, which fits the body of the customer, to give a wearing state which is well balanced and closest to ideal form for that customer.

2. Description of the Prior Art

It is well known in the art, as described in the gazette of Japanese Patent Laid-Open No. Hei 6-243201, to provide a method for manufacturing a foundation garment in which the body of a customer is measured by a non-contact three-dimensional measuring device, the three-dimensional physical body image data obtained as a result of the measurement being corrected and the foundation garment is manufactured in accordance with the corrected physical image data.

Although the aforementioned official gazette discloses the fundamental idea for the present invention, no disclosure is made on how to correct the three-dimensional physical image data obtained as a result of measurement to the ideal form.

SUMMARY OF THE INVENTION

This invention discloses a practical method for correcting the aforementioned three-dimensional physical body data to the ideal form, and a method for manufacturing foundation garment in which a pattern matching the corrected, ideal form obtained by the first method is prepared, cloth is cut according to the pattern, and the cut cloth is sewn together.

A summary of this manufacturing method is as follows.

At first, sizes of various parts of the body of persons (models, but not fashion models) having various kinds of physical shapes without underwear, are obtained in three-dimension. Then, with the person (model) wearing foundation garment to attain a more ideal form, the sizes of various parts of the body are obtained as three-dimensional data.

The data obtained in this way are accumulated.

Then, the sizes of various parts of the customer's body are measured both without underwear and with foundation garment for measurement purpose, to obtain data of the customer.

The data for a person having a physical body shape which is most similar to that of the customer are selected from the aforementioned accumulated data of persons having various physical shapes (models).

A predetermined physical portion of the customer's physical body image is cut out, and replaced with the same part of the physical body image of the model showing a more ideal form obtained by wearing foundation garment.

Since the model and the customer have different heights, girth and inclinations even at the same physical body portion, the height, girth and inclination of the model's physical body image is corrected to match the physical body image of the customer.

The correction is carried out by dividing the portion of the physical body into sections along its height direction, and transforming the data for each section.

A pattern is made from the data of physical body image of the model transformed to coincide with the physical body of the customer, cloth is then cut and sewn.

DETAILED DESCRIPTION OF THE PREFERRED EMBODIMENTS

Figure 1:
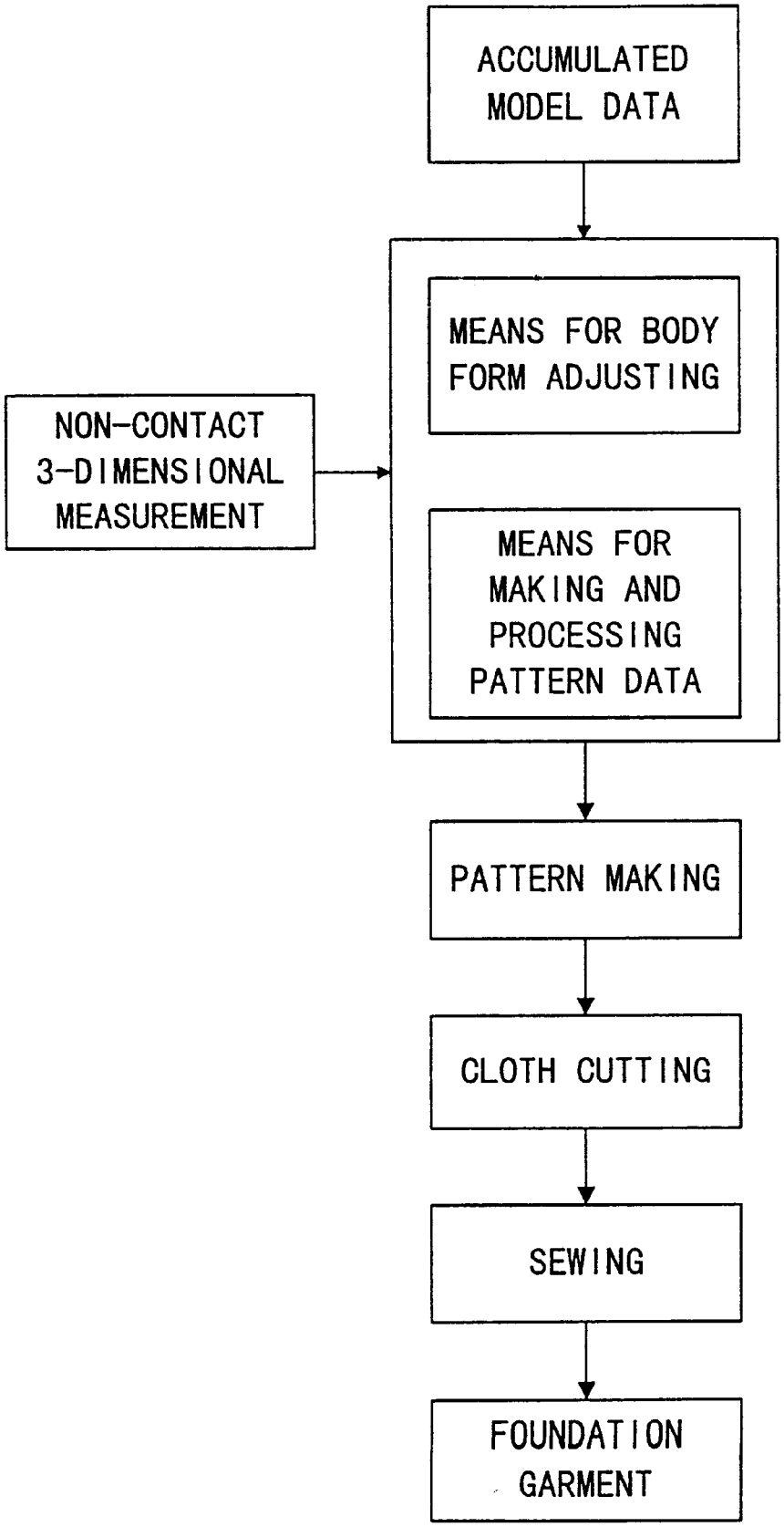
FIG. 1 is a schematic of the process according to the present invention.

FIG. 1 is a schematic of the process of the present invention. Referring to this figure, the present invention will be described in brief.

In the present invention, persons (models) having various kinds of physical body shapes are measured in advance and the accumulated data are stored.

When the most beautiful body form is attained as a result of the model wearing a foundation garment, the body surface positions of the model are measured at various heights by three-dimensional non-contact process.

Similar measurement is carried out for the same model without foundation garment.

As a result of these measurement, data for a certain model with and without foundation garment are obtained.

Such data are obtained for many models having various body forms and accumulated.

Customer data are obtained by performing similar measurements on the customer. However, as the foundation garment desired by the customer is not yet made, a foundation garment for measuring purpose is worn during measurement.

Once customer data is obtained, the model data which best approximates the customer data is selected from the accumulated data, and the selected model data is corrected by the method to be described below.

Pattern data corresponding to the body image is made by a Computer Aided Design (CAD) system or the like using the corrected model data, the pattern is made according to the pattern data, cloth is cut according to the pattern, and sewn together to obtain the foundation garment.

Figure 2:
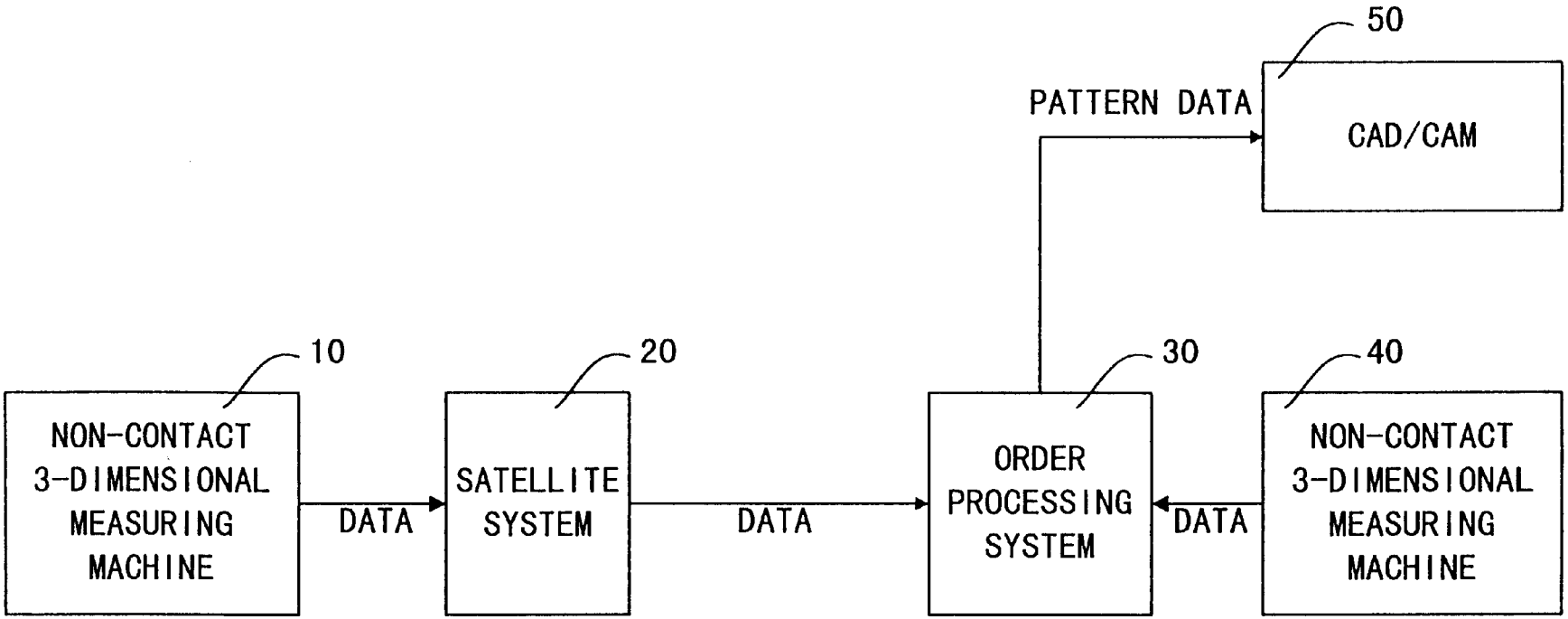
FIG. 2 is a schematic of the system for manufacturing foundation garment according to the present invention.

FIG. 2 is a schematic of the system for manufacturing foundation garment of the present invention. In this figure, 10 denotes a non-contact three-dimensional measuring machine, 20 denotes a satellite system, 30 denotes an order processing system, 40 denotes a non-contact three-dimensional measuring machine, and 50 denotes a Computer Aided Design/Manufacturing (CAD/CAM) system.

The non-contact three-dimensional measuring machine 10 and the satellite system 20 are installed at a underwear sales corner in a department store, for example. The non-contact three-dimensional measuring machine 10 measures the customer's body, wherein a system called BL (Body Line) scanner described in "Jidoka Gijutsu (Automation Technology)" Vol. 26, No. 10, pp. 56–62 can be used.

The three-dimensional body image data of the customer obtained as a result of measurement performed by the non-contact three-dimensional measuring machine 10 is delivered to the satellite system 20. The satellite system 20 converts the three-dimensional physical body image data expressed in orthogonal (X-Y) coordinates into cylindrical coordinates. Such conversion is carried out at an interval of 5 mm height on the Z-coordinate.

The satellite system 20 can also make the best balanced three-dimensional body image data for the customer, from the customer data and the accumulated model data.

The three-dimensional physical body image data for the customer made in this way or the pattern data made from this data, is sent together with the. data obtained from the customer to the order processing system 30 located at the manufacturing site such as the factory through communication lines.

The three-dimensional body image data best suited to the customer may also be made at the order processing system 30 instead of the satellite system 20.

The order processing system 30 sends the pattern data to CAD/CAM system 50. The CAD/CAM system 50 makes the pattern and cuts the cloth. After this operation, the cut cloth is sewn together.

A non-contact three-dimensional measuring machine 40 may be installed also at the manufacturing site, and the body of the customer and the model can be measured at the factory. The non-contact three-dimensional measuring device 40 may be the same as the aforementioned non-contact three-dimensional measuring device 10, or the system described in gazette of Japanese Patent Laid-Open No. Sho 64-34329 or gazette of Japanese Patent Laid-Open No. Hei 1-121707 may be used.

Figure 3:
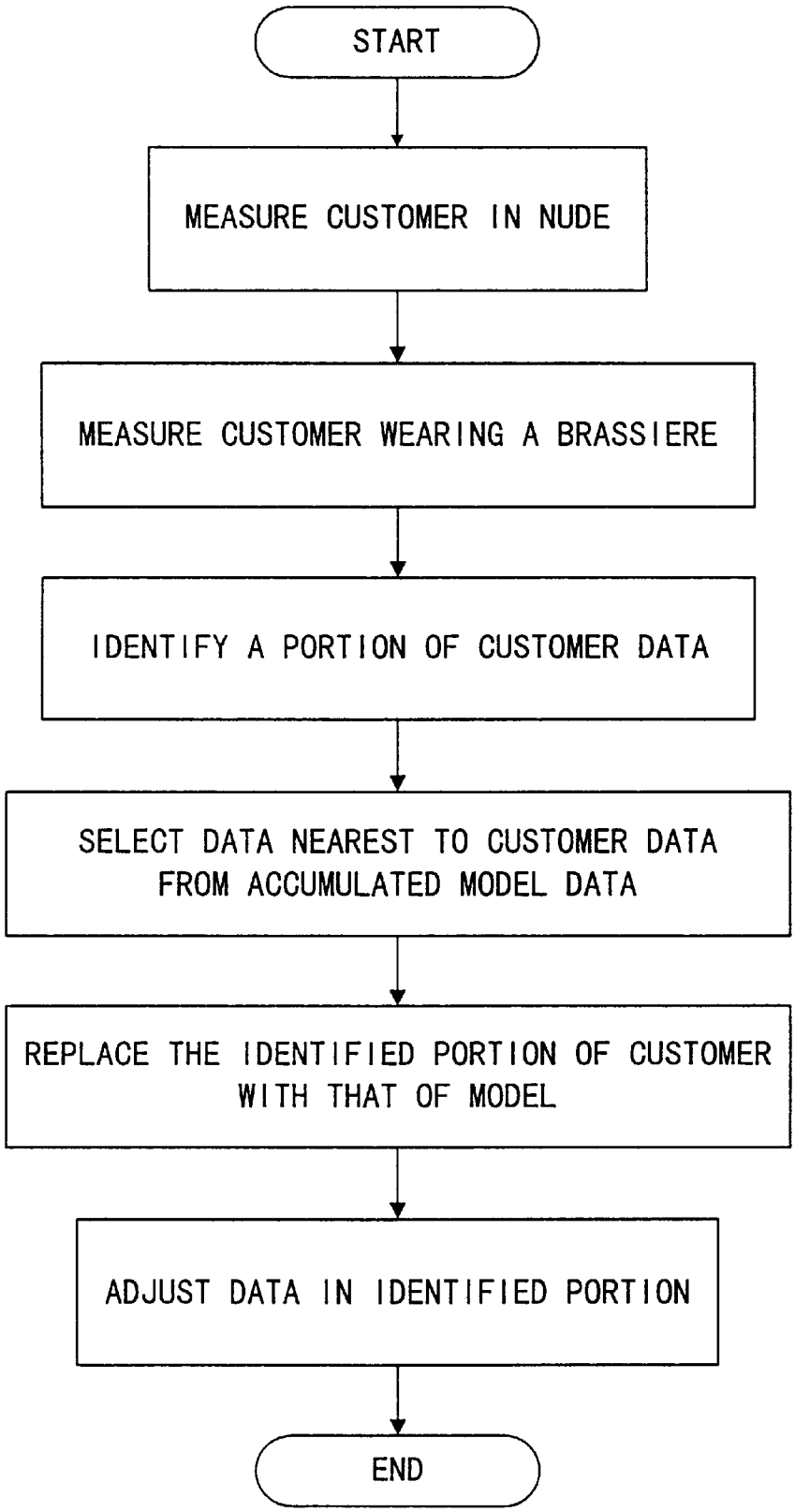
FIG. 3 shows the flow of the process for correcting the bust portion of data from a model, for foundation garment for the bust portion, i.e. a brassiere or a bodysuit.
Figure 4A:
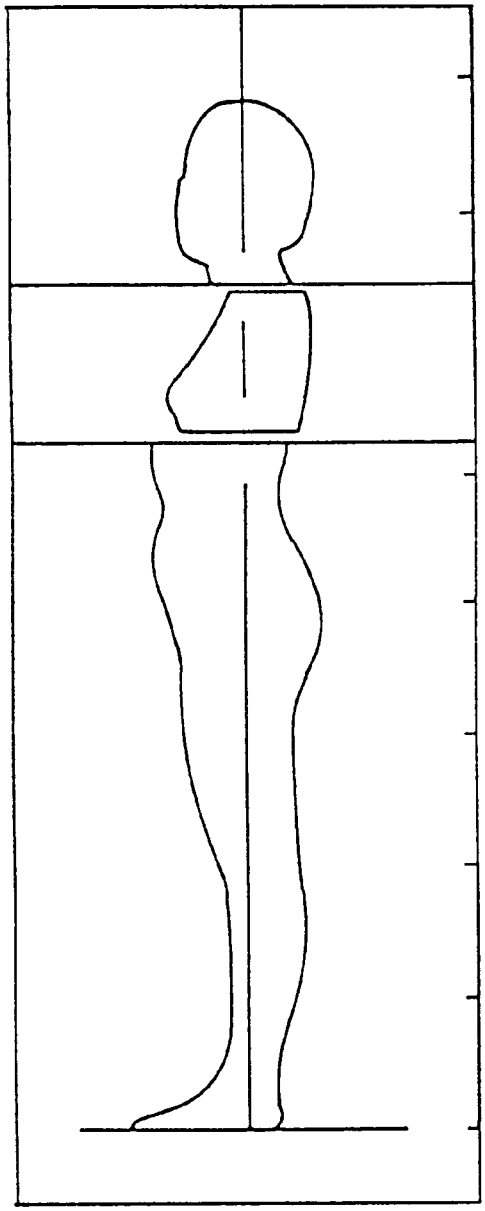
FIGS. 4A and 4B illustrate the manner in which the bust portion of the customer is replaced with the bust portion of the model.
Figure 4B:
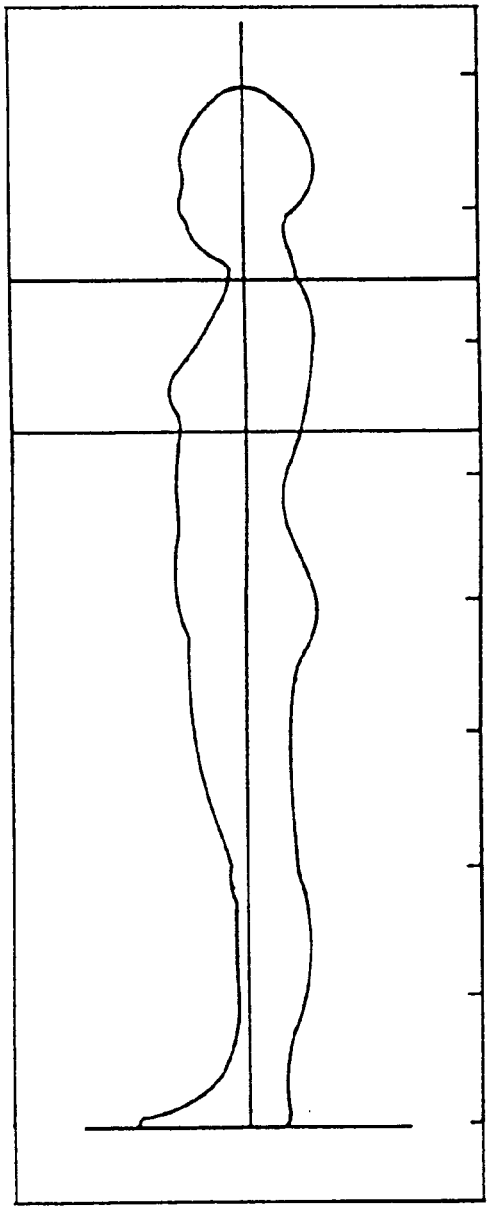

FIG. 3 illustrates the process for body form conversion carried out at the satellite system 20 or the order processing system 30, taking the conversion process for the bust portion as an example. FIG. 4 shows the manner in which the bust section of the customer measured without foundation garment is replaced with the adjusted bust portion of the model data.

The present invention will now be described, taking as an example the method for manufacturing a brassiere or bodysuit.

First, the body of the customer without foundation garment is measured. Then, the physical body of the customer is measured wearing a brassiere. The reason for measuring with a brassiere on is for determining the under bust position on customers with drooping breasts.

The following processes ①, ②, ③ and ④ are carried out next.

① A body shape closest to the customer's body shape is selected from among the accumulated model data. By model data is meant a file used in the correction of the body image of the customer and each of the files contains a three-dimensional data of a body. A file name is comprised of item number, first condition, second condition and third condition.

First condition: the difference between top-bust girth and under-bust girth when brassiere is worn.

Second condition: the difference between under-bust height when in nude and under-bust height when brassiere is worn.

Third condition: the difference between top-bust height and under-bust height when in nude.

The model data which is nearest to the customer data is selected on basis of first, second and third conditions. Model data is selected on basis of item number of the bodysuit or brassiere which the customer wishes to purchase, before the correction data is selected on basis of first to third conditions.

② The bust transformation domain for the nude data of the customer and model (data of the customer in nude and the model wearing foundation garment) are selected. The height between shoulder and under-bust position is selected as the bust transformation domain.

③ The bust portion is removed from the customer's nude data, and replaced with the bust portion from the model data (data of the model wearing foundation garment)(FIG. 4). However, since it looks unnatural in this state, the following processes are carried out.

(1) Heights of both bust sections are aligned.

(2) Inclinations of both bodies are aligned.

(3) Cross section of model data is transformed to match customer's nude data.

(4) Adjustments are made for smooth transition at extremities.

④ Completion of bust transformation

In the following description, the upward vertical direction is defined as Z direction, forward direction with respect to the body is defined as −X direction (accordingly, rearward direction is defined as +X direction) and rightward direction with respect to the body is defined as +Y direction (accordingly, leftward direction is defined as −Y direction). Also, the azimuth about Z-axis with respect to the X-axis is denoted by $\gamma$.

In order to execute the bust transformation process shown in FIG. 3, it is necessary to find out automatically each position on the body. Each position on the body is automatically located as follows. The three-dimensional body image is expressed in cylindrical coordinates.

Top head position (height):

Polar coordinates expressing the section of body are checked while the height is varied in sequence from lower to higher values. The height where all moving diameters of the polar coordinates become 0, is defined as the position of the top head.

Crotch position:

The number of section at the waist is 1 while the number of sections at the legs is 2. The position (height) where the number of sections changes from 1 to 2 is defined as the crotch position.

Figure 5B:
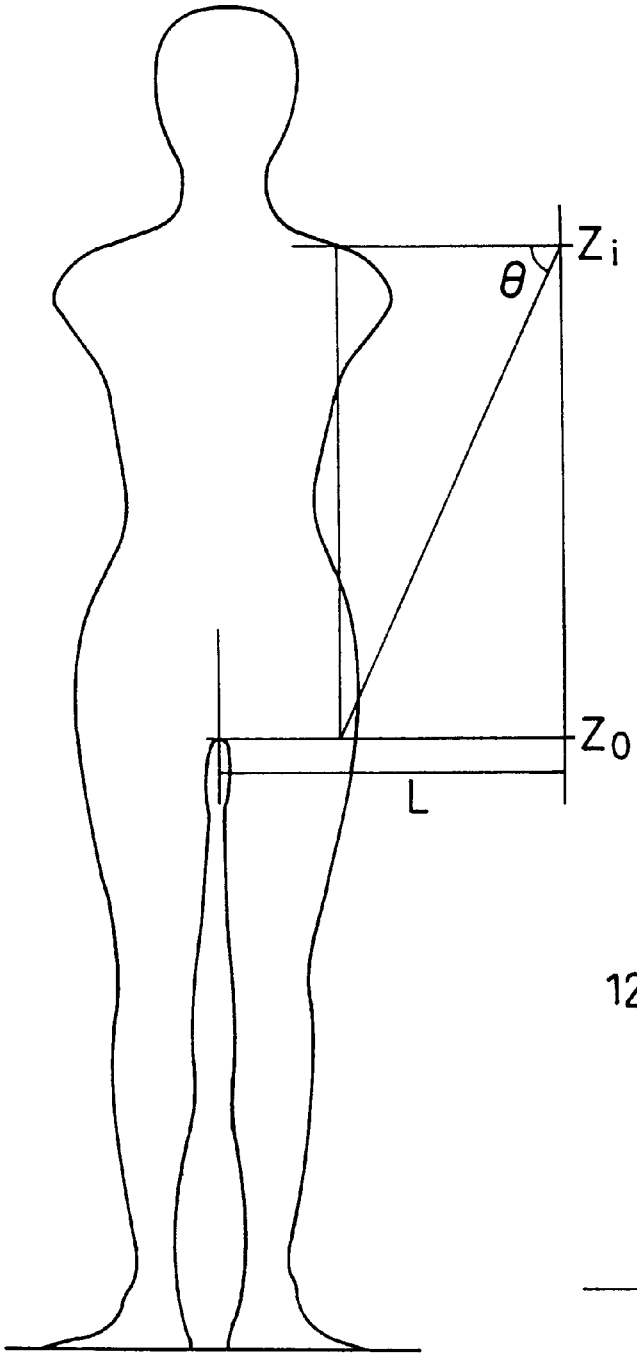
FIG. 5B illustrates the method for determining the shoulder position.
Figure 5A:
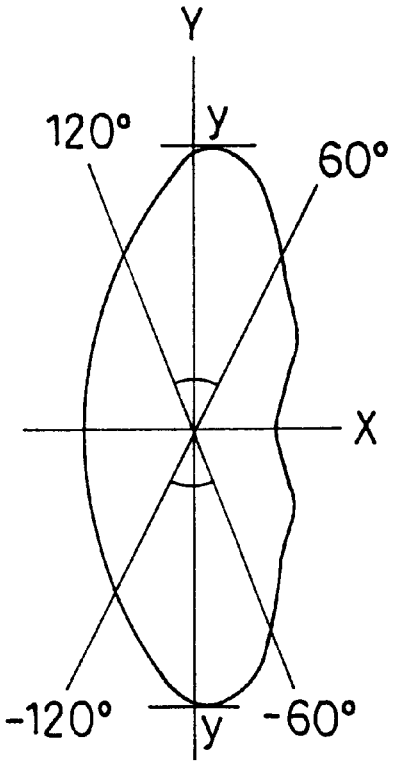
FIG. 5A shows a section of the human body at a certain height, to indicate the domain through which the maximum or minimum value of Y is searched.

Shoulder position:

FIGS. 5A and 5B illustrate the process for determination of the position of shoulder. Positions above the crotch position are scanned in the following manner. At first, the point where y shows the maximum value within a domain of $\gamma=60°$ to 120° and the point where Y shows the minimum value within a domain of $\gamma=-60°$ to $-120°$ are found for every section. It is assumed that the section is arranged in such a manner that the front of the body faces leftward (−X direction) and the rear of the body faces rightward (+X direction). The vertical direction is defined as the Z-axis direction, and the lateral direction (direction from left shoulder to the right) is defined as the Y-axis direction, while the depth (longitudinal) direction (direction from belly to the back) is defined as the X-axis direction.

The height of the crotch position is denoted $Z_0$. At position $Z_i$ along the Z-axis above crotch position, the maximum value of Y is denoted as $Y_{i1}$ and the minimum value is denoted as $Y_{i2}$.

$\theta_1$ and $\theta_2$ are calculated by the following equations:

$$\tan\theta_1=(Z_i-Z_0)\div(L-Y_{i1})$$

$$\tan\theta_2=(Z_i-Z_0)\div(L+Y_{i2})$$

where, L is a constant.

$\theta_1$ and $\theta_2$ are also calculated the next higher value of $Z_i$. Then, the position (height) where the differential of either angle $\theta_1$ or $\theta_2$ changes from positive to negative or from negative to positive for the first time, is defined as the shoulder position. If the two height positions found in this way differ from each other, their mean value is adopted. FIG. 5B is a silhouette of the body viewed from the rear (with the arms are omitted). As apparent from this figure, angle θ at the position of the shoulder has an inflection point.

Figure 6:
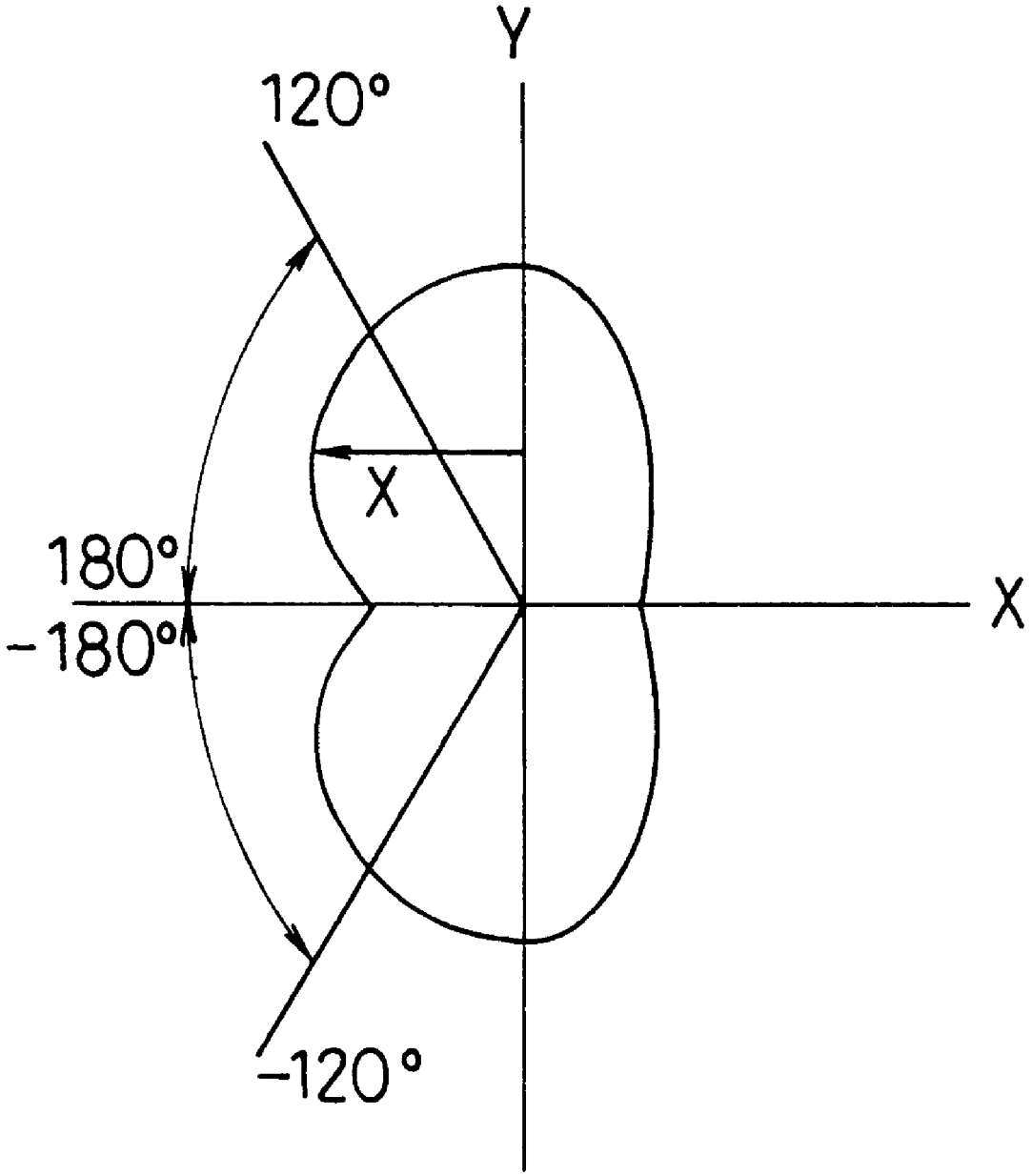
FIG. 6 illustrates the method for determining the top bust position.

FIG. 6 illustrates the determination process for the position of the top-bust. Search is started from a position 10 cm below shoulder position. The minimum values for X in a domain of $\gamma=120°$ to 180° and $\gamma=180°$ to 240° are found and the mean of the two minimum values of X is newly defined as X. The value of X is also found in similar fashion for the next lower section. The height where the differential between two consecutive values of X's changes from negative to positive for the first time is found. The girth is calculated within a 3 cm band below the height thus found, and the position of maximum girth is defined as the position of top-bust.

Figure 7A:
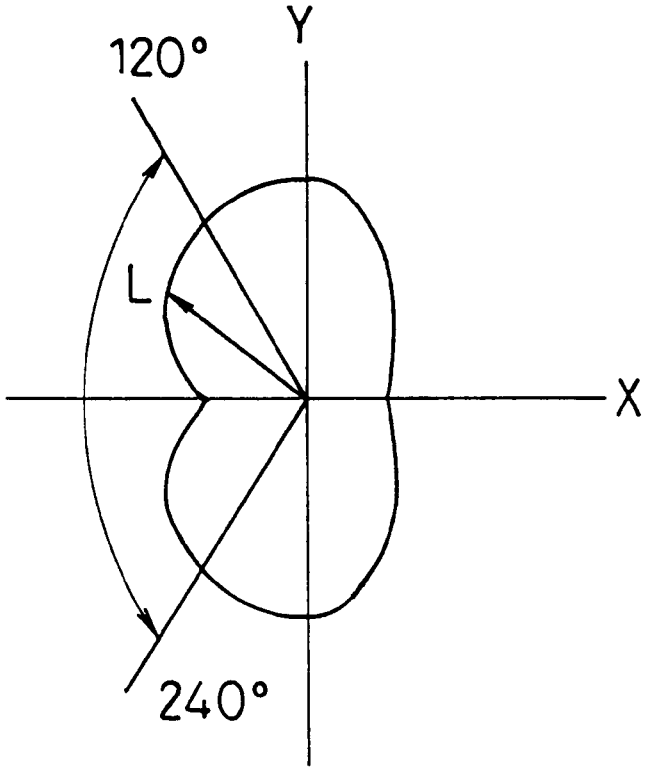
FIGS. 7A and 7B illustrate the method for determining the under-bust position.
Figure 7B:
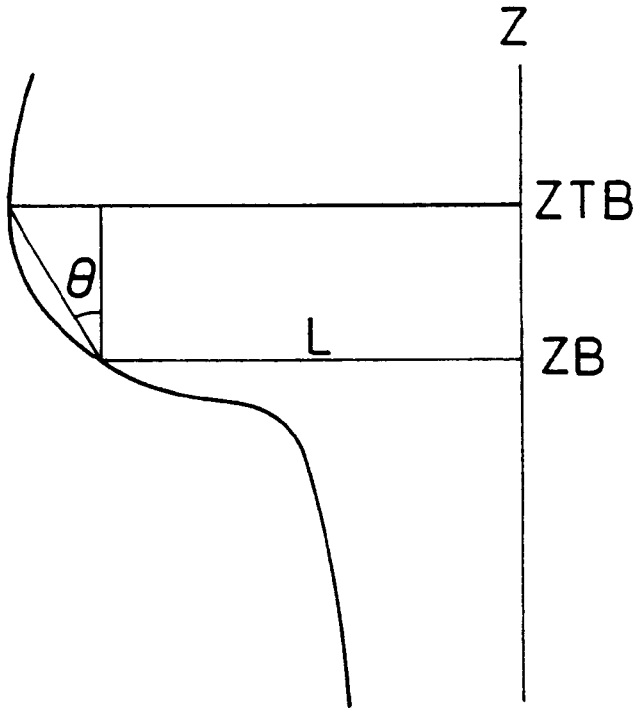

FIGS. 7A and 7B illustrate the determination process for the position of the under-bust.

FIG. 7A shows the cross section of as the body image at top-bust position. In FIG. 7A, the point where the distance L from the Z axis to the surface of the body shows a maximum value is found, in a domain of $\gamma=120°$ to 240°. The vertical section through Z-axis and the direction of maximum L is shown in FIG. 17B.

In FIG. 7B, the body surface position at top-bust position (TB) and the body surface at height ZB below the top-bust are connected by a linear line. The height where an angle θ formed by the line with respect to the Z-axis becomes largest is defined as the position of under-bust.

Figure 8:
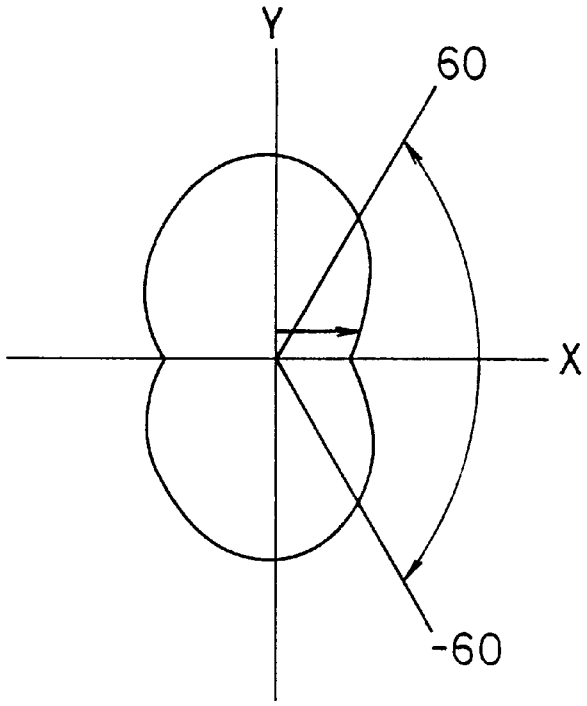
FIG. 8 illustrates the method for determining the hip position.

FIG. 8 illustrates the determination process for the hip position. The height at which the value of X is largest, within a domain of height between 60 and 110 cm, and $\gamma=-60°$ to +60°, is defined as the hip position.

Figure 9:
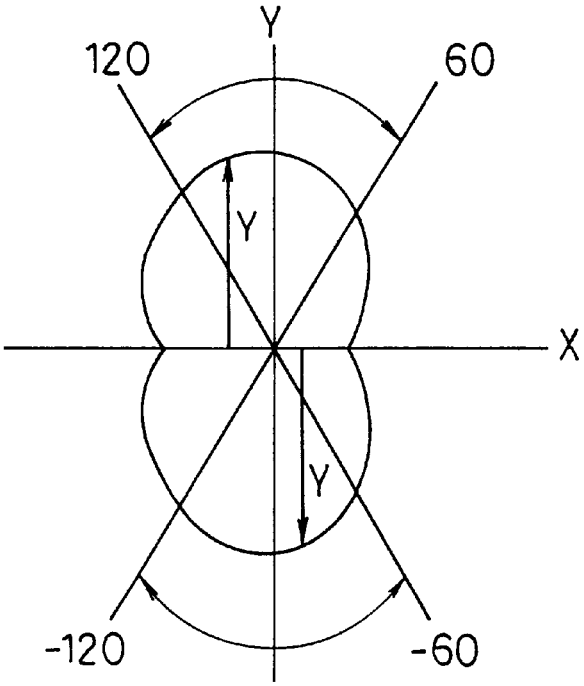
FIG. 9 illustrates the method for determining the waist position.

FIG. 9 illustrates the determination process for the hip position. The portion between under-bust position and hip position is searched in order to determine the waist position. The largest value of the Y within a domain of $\gamma=60°$ to 120° is found for each cross section, and the height at which the largest values of Y becomes minimum is found. Similarly, the least value of Y within a domain of $\gamma=-60°$ to $-120°$ is found, and the height at which the least values of Y becomes maximum is found. The mean of the two heights is defined as the waist position.

Figure 10A:
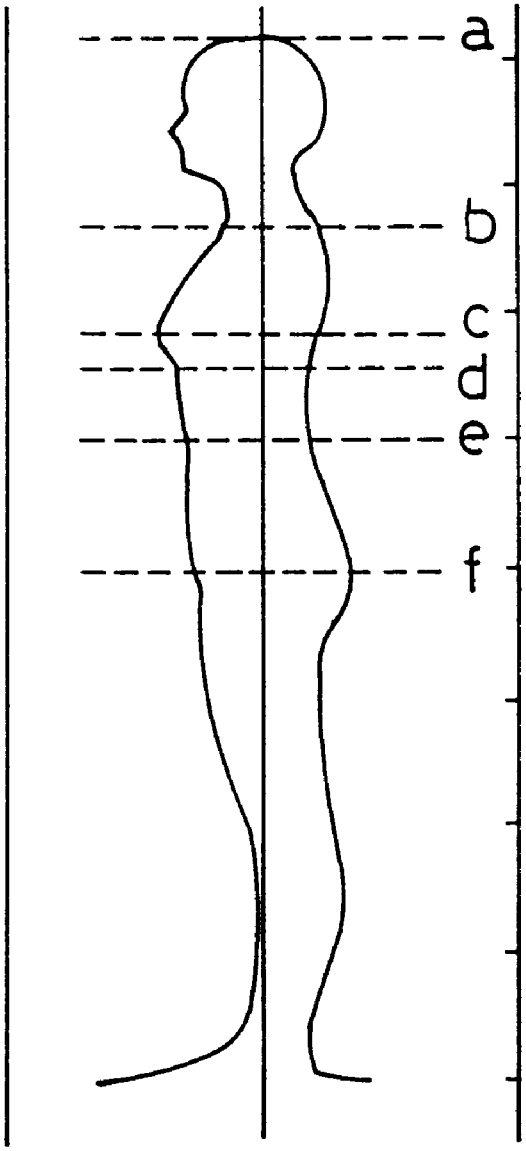
FIGS. 10A and 10B show the silhouette of a model drawn from data obtained by measuring the model with and without underwear respectively.
Figure 10B:
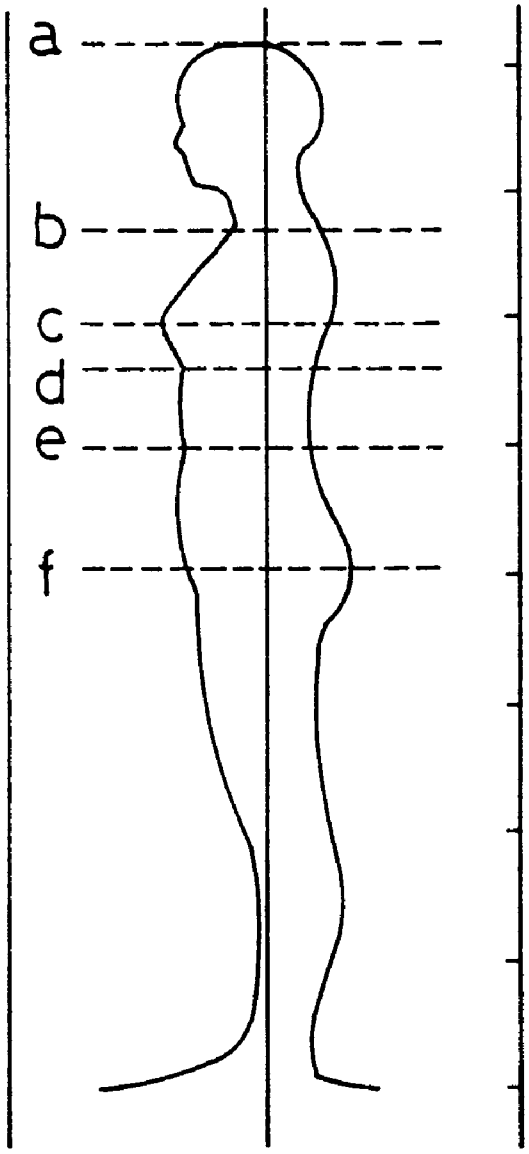

FIGS. 10A and 10B show the silhouette of a model drawn from data obtained with and without underwear, respectively. The head top position a, shoulder position b, top-bust position c, under-bust position d, waist position e and hip position f are found in the manner described above in each case and are indicated on the silhouettes.

Search data (index) is made from the three-dimensional measurement data thus collected. The index could be in the form BS7 150 50 100, for example. In this example, "BS7" denotes the item number of the foundation garment to be worn by the customer, "150" denotes the difference in girth at top-bust and at under-bust with the customer in nude, "50" denotes the change in height of the under-bust with the customer in nude and when wearing foundation garment, "100" denotes the difference in height between top-bust and under-bust with the customer in nude. There are various sizes in the product called BS7.

The measured three-dimensional data as well as girth and height of each section with the customer wearing foundation garment are registered as one file, with a file name of the index described above. There are many such files, and each file is given a file name.

In order to select the model data file which is the best match to the body of the customer, the aforementioned index is made up from the item number requested by the customer and the body image data of the customer. Then a model data file having the file name which is the nearest to this index is selected.

Figure 11A:
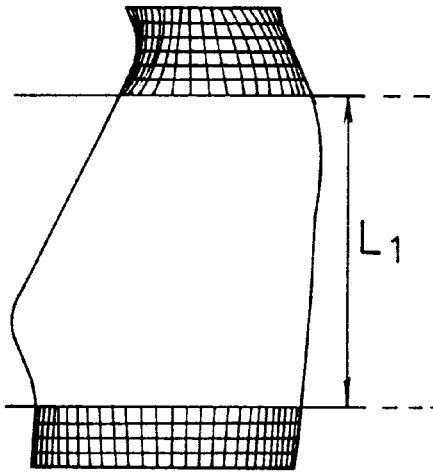
FIGS. 11A and 11B illustrate the alignment of the height of a customer's bust portion to the height of the model's bust portion.
Figure 11B:
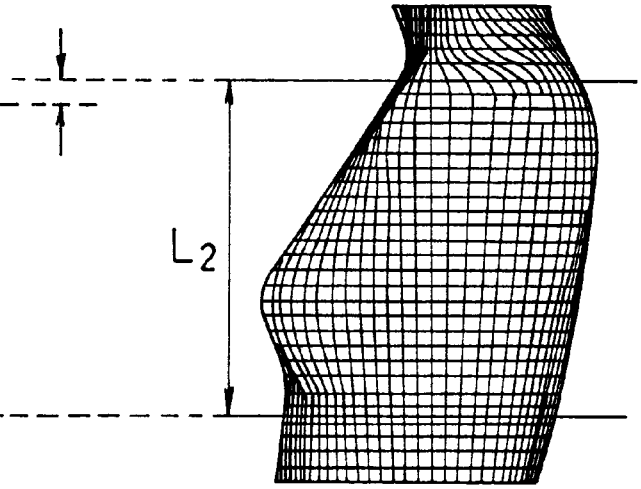

Referring to FIGS. 11A, 11B, bust height alignment in the processing of the bust transformation program shown in FIG. 3 will be described. In the figure, the X-axis is shown as the abscissa and the Z-axis as the ordinate. FIG. 11A shows a bust section drawn from the nude data of the customer and FIG. 11B shows a bust section drawn from model data.

The height of the bust portion of the customer's nude data is L1 while the height of the bust portion for the model data is L2. In order to align L2 with height L1, the bust portion from the model data needs to be expanded or compressed in the vertical direction. However, since for the three-dimensional data in cylindrical coordinates, the coordinate along the vertical axis needs to be a multiple of the vertical interval of 5 mm, applied only by a value of times of integer, the data for the expanded or compressed bust portion of the model must be converted to values at 5 mm intervals by interpolation, as the vertical expansion or compression would alter the vertical intervals of the data.

FIGS. 12A to 12E illustrate the adjustment for inclination of the body.

For the bust portion in the model data, the height alignment process already described above has been carried out. As a result, in FIGS. 12A and 12B, the upper end (shoulder position) b1 and the lower end (under-bust position) d1 of the bust portion for the customer in nude, and the upper end (shoulder position) b2 of the lower end (under-bust position) d2 of the bust portion for the model data coincide with each other.

Figure 12A:
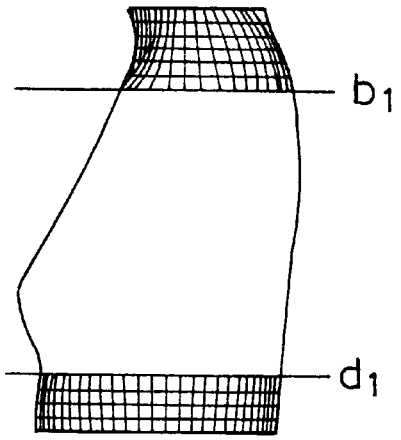
FIGS. 12A to 12E illustrate the adjustment for inclination of the body.
Figure 12B:
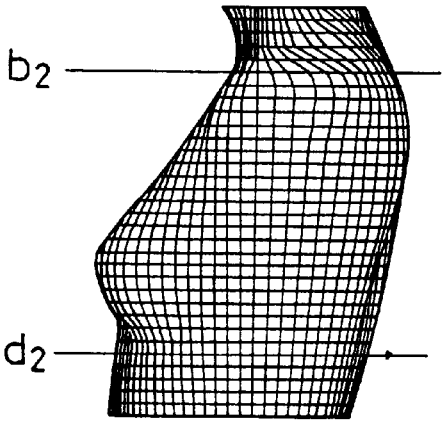
Figure 12C:
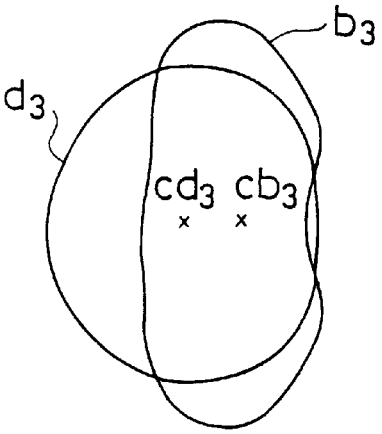

FIG. 12C illustrates the body section contour b3 and its center cb3 at height b1 (shoulder position), and the body section contour d3 and its center cd3 at height d1 (under-bust position) for the bust portion from the customer's nude data, respectively.

Figure 12D:
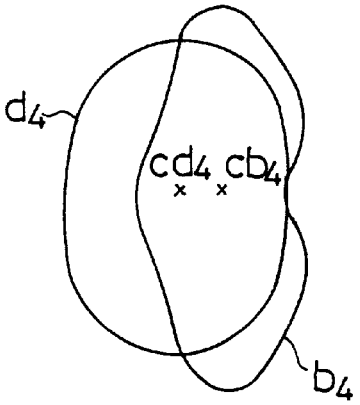

FIG. 12D illustrates the body section contour b4 and its center cb4 at height b2 (shoulder position), and the body section contour d4 and its center cd4 at height d1 (under-bust position) for the bust portion from the customer's data, respectively.

Figure 12E:
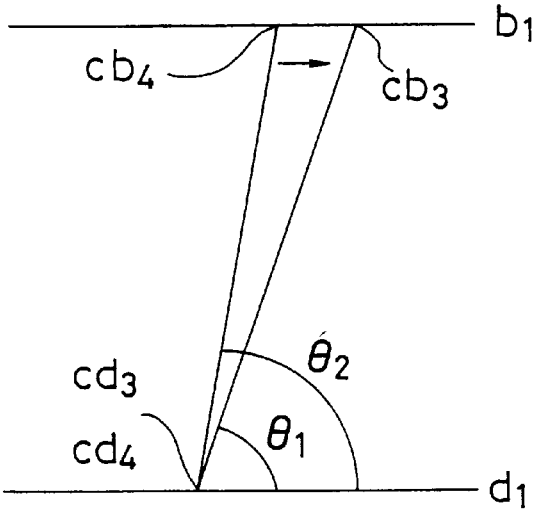

FIG. 12E illustrates the inclination of the bust portion, wherein the line connecting center cb3 with the center cd3 indicates the inclination $\theta_1$ of the body of the customer and the line connecting center cb4 with center cd4 indicates the inclination $\theta_2$ of the bust portion based on the model data.

Normally, as relation $\theta_1=\theta_2$ is not found, the section at the top of the bust portion of the model data is shifted until center cb4 coincides with center cb3, to attain the relation $\theta_1=\theta_2$. Other intermediate sections are shifted by amounts proportional to their height positions.

As a result of shifting sections as described above, the inclination $\theta_2$ of the bust portion obtained from model data matches the inclination $\theta_1$ of the bust portion of the customer.

Figure 13:
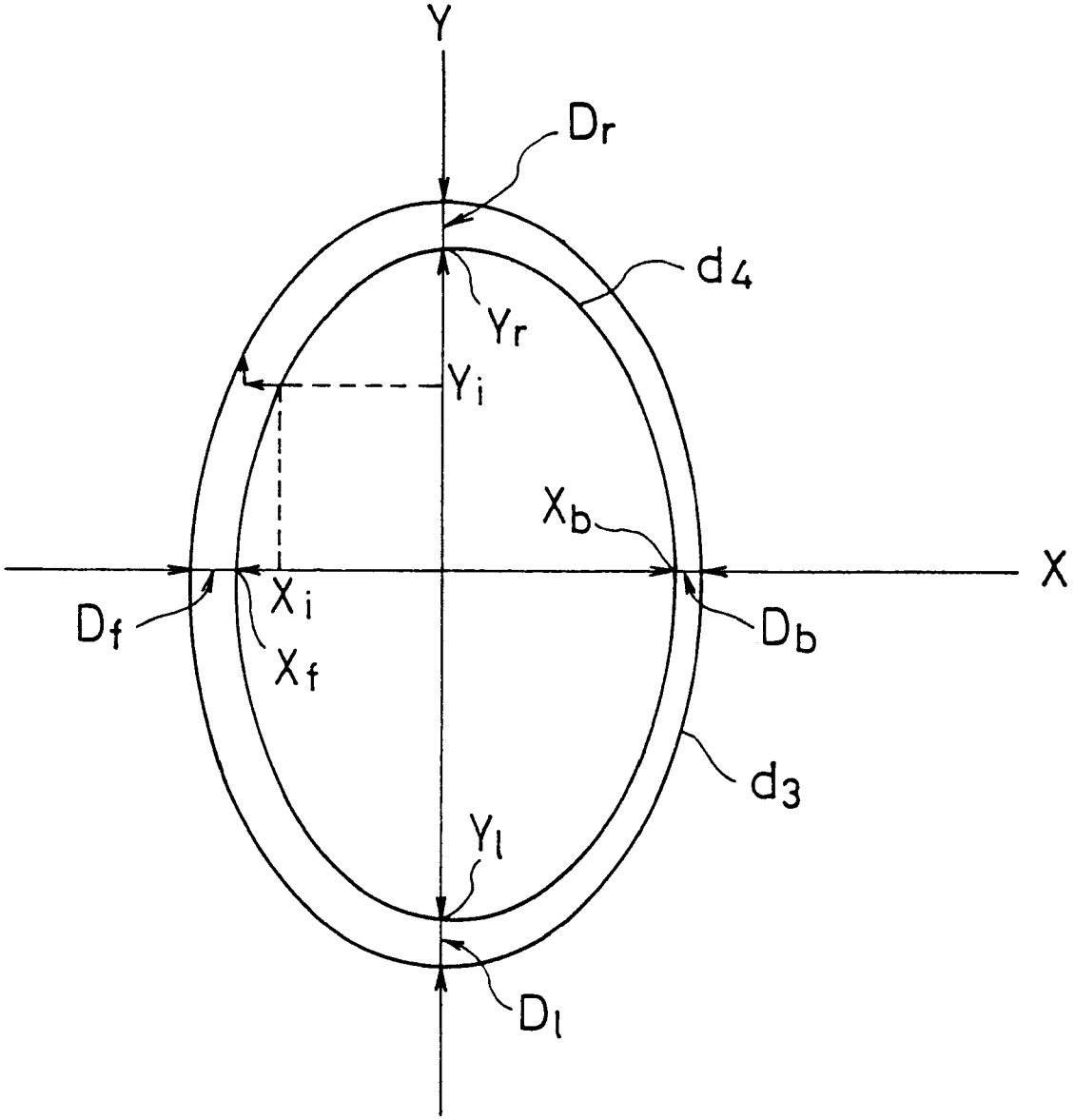
FIG. 13 illustrates the method for adjusting the size of a section at the top and bottom of the bust

FIG. 13 illustrates the transformation of cross-section of a nude. The transformation includes the following processes:

1. deformation process of the model data bust at the lower end of bust portion to conform with the customer's nude data.
2. deformation process of the model data bust at the upper end of bust portion to conform with the customer's nude data.
3. process of expressing the deformed model data bust in cylindrical coordinates taken at 2-degree increments.

The deformation process for the model data bust at the lower end of bust portion to conform with the customer's nude data will be described. At first, the differences at front, at rear, at right side and at left side are calculated from the cross-sections at the lower end of bust portion of the customer's nude data and model data.

It is assumed that the contour of the cross-section at the lower end of model data is expressed by $P_0$ $(x_0, y_0)$, $P_1$ $(x_1, y_1)$, . . . $P_{179}$ $(x_{179}, y_{179})$, where $P_i$ $(x_i, y_i)$ denotes the point where a radius with azimuth with respect to the X-axis of 2×i degrees crosses the contour line in the plane at the lower end of bust portion.

When $P_i$ lies on the positive X-axis, $P_i$ is moved by a distance corresponding to the difference $D_b$ at the rear in the positive X direction. When $P_i$ lies on the negative X-axis, $P_i$ is moved by a distance corresponding to the difference $D_f$ at the front in the negative X direction. When $P_i$ lies on the positive Y-axis, $P_i$ is moved by a distance corresponding to the difference $D_r$ at the right side in the positive Y direction. When $P_i$ lies on the negative Y-axis, $P_i$ is moved by a distance corresponding to the difference $D_l$ at the left side in the negative Y direction.

When $P_i$ lies between the positive Y-axis and the negative X-axis, $P_i$ is moved in the negative X direction by a distance equal to the product of difference $D_f$ at front with Y-axis ratio, and moved in the positive Y direction by a distance equal to the product of difference $D_r$ at right side with X-axis ratio, where Y-axis ratio is given by $1-Y_i/Y_r$, $Y_r$ being the value of Y-coordinate at the point where the positive Y-axis crosses the contour of the cross-section at the lower end of model data. The X-axis ratio is given by $1-x_i/x_f$, $x_f$ being the value of X-coordinate at the point where the negative X-axis crosses the contour of the cross-section at the lower end of model data.

When $P_i$ lies between the negative Y-axis and the negative X-axis, $P_i$ is moved in the negative X direction by a distance equal to the product of difference $D_f$ at front with Y-axis ratio, and moved in the negative Y direction by a distance equal to the product of difference at left side with X-axis ratio.

The Y-axis ratio is given by $1-Y_i/Y_l$, $Y_l$ being the value of Y-coordinate at a point where the negative Y-axis crosses the contour of the cross-section at the lower end of model data. The X-axis ratio is given by $1-X_i/X_f$, $x_f$ being the value of X-coordinate at the point where the negative X-axis crosses the contour of the cross-section at the lower end of model data.

When $P_i$ lies between the negative Y-axis and the positive X-axis, $P_i$ is moved in the positive X direction by a distance equal to the product of difference $D_b$ at the rear with Y-axis ratio, and moved in the negative y direction by a distance equal to the product of difference $D_l$ at left side with X-axis ratio. The Y-axis ratio is given by $1-Y_i/Y_l$, $Y_l$ being the value of Y-coordinate at the point where the negative Y-axis crosses the contour of the cross-section at the lower end of model data. The X-axis ratio is given by $1-x_i/x_b$, $x_b$ being the value of X-coordinate at the point where the positive X-axis crosses the contour of the cross-section at the lower end of model data.

When $P_i$ lies between the positive Y-axis and the positive X-axis, $P_i$ is moved in the positive x direction by a distance equal to the product of difference $D_b$ at rear with Y-axis ratio, and moved in the positive Y direction by a distance equal to the product of difference $D_r$ at right side with X-axis ratio. The Y-axis ratio is given by $1-Y_i/Y_r$, and $Y_r$ being the value of Y-coordinate at the point where the positive Y-axis crosses the contour of the cross-section at the lower end of model data. The X-axis ratio is given by $1-x_i/x_b$, $x_b$ being the value of X-coordinate at the point where the positive X-axis crosses the contour of the cross-section at the lower end of model data.

The model data bust is expressed by a group of plural cross-sections present between the lower end and the upper end of the model data. The difference at the front for each cross-section is given by the difference at the front at the lower end of the model data multiplied by Z-axis ratio, the difference at the rear for each cross-section is given by the difference at the rear at the lower end of the model data multiplied by Z-axis ratio, the difference at the right side for each cross-section is given by the difference at the right side at the lower end of the model data multiplied by Z-axis ratio, and the difference at the left side for each cross-section is given by the difference at the left side at the lower end of the model data multiplied by Z-axis ratio. The Z-axis ratio is defined by $1-(Z-Z_1)/(Z_2-Z_1)$ where Z=height of section, $Z_1$=height of lower end of model data, $Z_2$=height of top end of model data. Each cross-section is deformed by the same method as the one used for the cross-section at the lower end of the model data.

The transformation process of model data bust at the upper end of the bust portion is similar to the transformation process for the lower end of bust portion.

Figure 14A:
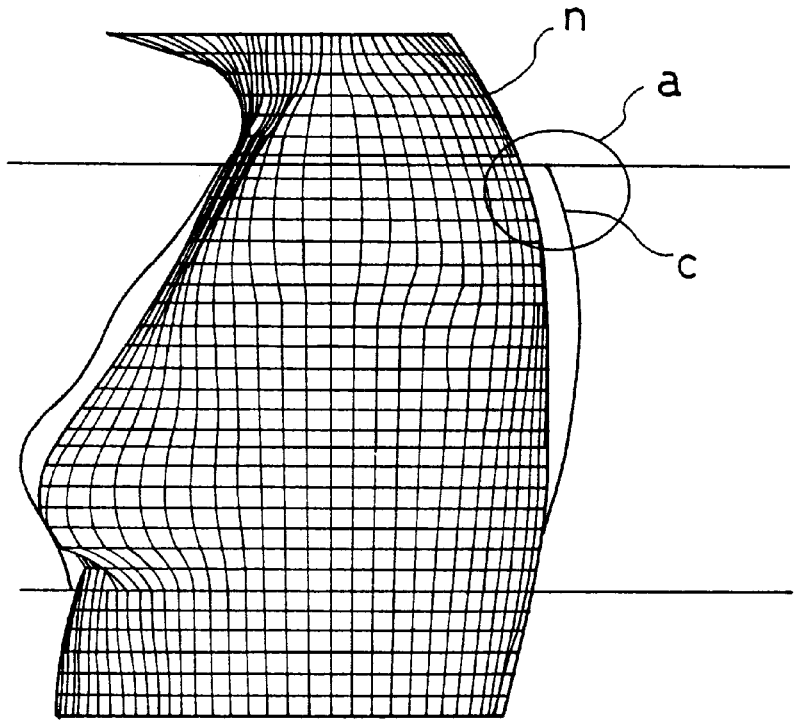
FIGS. 14A and 14B illustrate the method of correction for smooth transition at the extremities of the corrected portion.
Figure 14B:
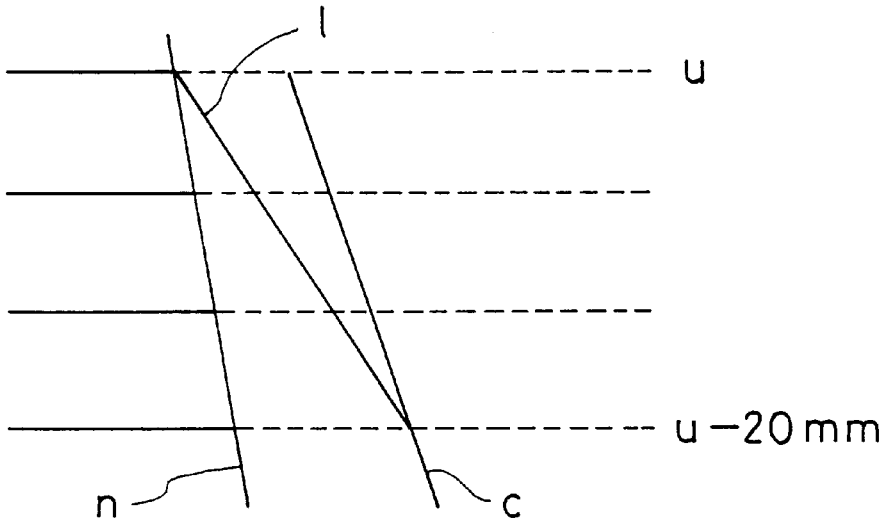

FIGS. 14A and 14B illustrate the adjustment for smooth transition at connections. Even after height adjustment, body inclination adjustment and transformation of cross sections of the bust portion of model data, application of the processed model data bust C to the bust portion of the nude may result in discontinuity at connections (upper and lower ends), as indicated in enclosure (a) (FIG. 14A). Therefore, a process for smooth transition at connections is carried out.

The process for making smooth transition is carried out as follows:

① For the top end of the bust portion, each point C along the contour of cross-section of the model data at a height 20 mm below the top of the bust portion is connected to the corresponding point U along the contour of cross-section of the customer's nude data at the top of the bust portion, by a straight line. The contours at intermediate cross-sections are obtained by linear interpolation along these lines.

② For the bottom end of the bust portion, a similar process is carried out, with lines connecting points along the contour of cross-section of the model data at a height 10 mm above the bottom of the bust portion, and points along the contour of cross-section of the customer's nude data at the bottom of the bust portion.

By performing the above processes, the bust portion of the customer is replaced with a modified bust portion of a model that has been corrected to a well-balanced state. A pattern data is prepared from the data of the result of conversion. A pattern is made from the pattern data using a CAD/CAM system, and cloth is cut, or cloth may be cut using the pattern data without making a pattern, and then sewn.

Figure 15:
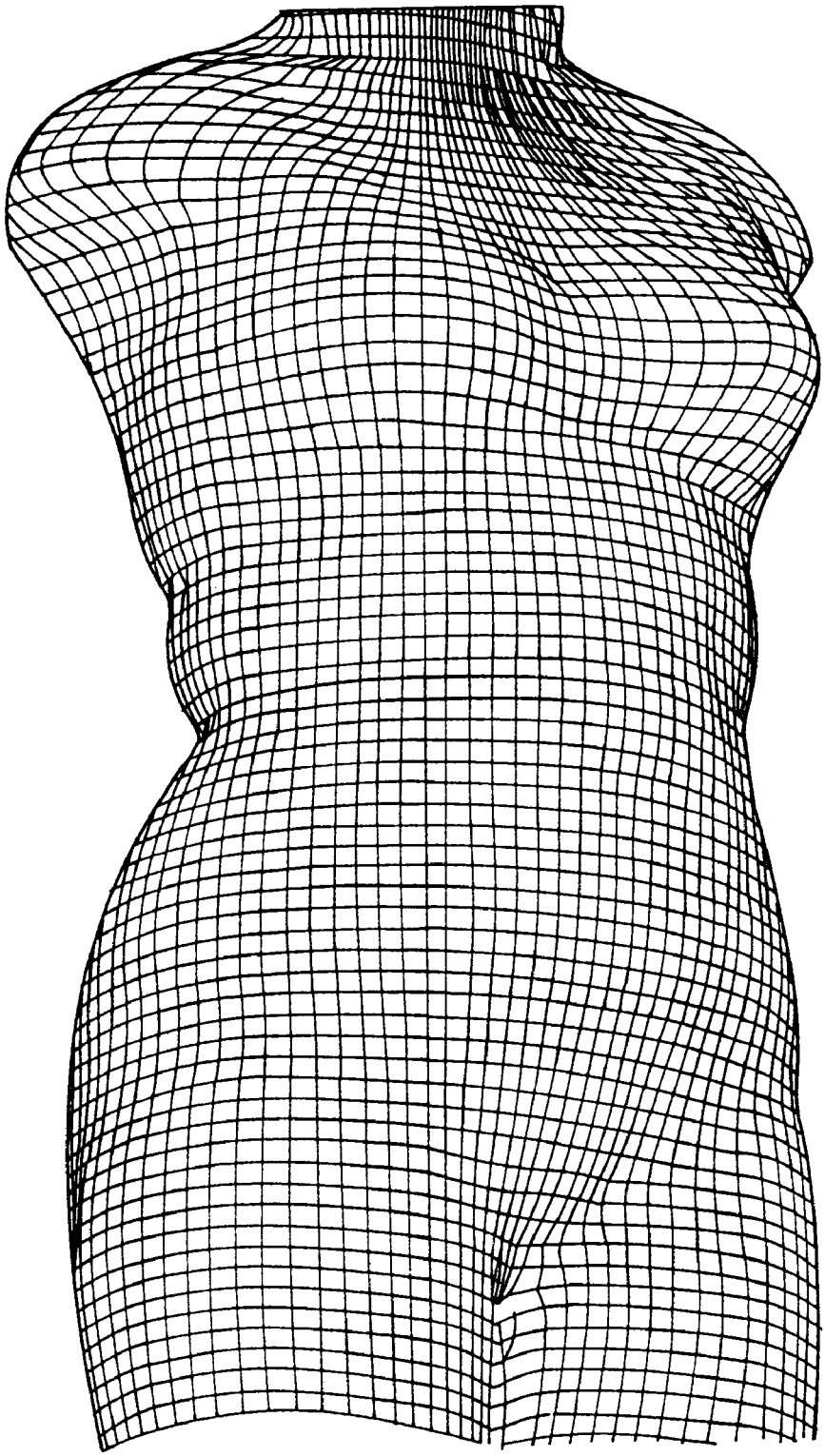
FIG. 15 displays in three-dimension, the body form which could be attained with the customer wearing the foundation garment.

FIG. 15 shows one example of the body image of a customer which will be realized if this foundation garment is put on, in a three-dimensional display, based on data obtained by the conversion process described. By looking at this body image, the customer can foresee her body shape when wearing the foundation garment. With such an arrangement, the customer can order the foundation garment with full understanding about how the foundation garment to be purchased, will work.

Thus, it is possible to attain a foundation garment which is the best fit for the body shape of a customer, and produces a well-balanced and closer to ideal, beautiful body shape.

Although the foregoing description provides, as one example, a method for manufacturing a foundation garment for the bust section, i.e. a brassiere or a bodysuit, since it is apparent that the disclosed technical concept can be applied to methods for manufacturing foundation garments for other parts of the body, the present invention should not be construed to be restricted to the method of manufacturing the foundation garment for the bust section.

In accordance with the present invention, there is provided a foundation garment which is the best fit for the body shape of a customer, and produces a well-balanced and closer to ideal, beautiful body shape.

What is claimed is:

1. A method for manufacturing a foundation garment comprising the following processes a, to m, in sequence:

a. forming a model data base by accumulating three-dimensional data, in cylindrical coordinates, obtained by measuring body surface positions at varying heights, at intervals of 5 mm, on models of varying body forms, both without underwear and in a condition wearing a foundation garment, b. obtaining three-dimensional data, in cylindrical coordinates, of a customer by measuring body surface positions at varying heights, at intervals of 5 mm, both without underwear and wearing a foundation garment for measurement purpose, c. identifying the height domain of a portion on the customer's body, using said three-dimensional data of the customer, d. selecting a model data measured with the foundation garment, in a domain corresponding to said height domain of a portion on the customer's body, and which most closely resembles the customer's data in said portion, e. height correcting for aligning the vertical dimension of the portion on the selected model data with the vertical dimension of the portion on the customer's body, f. correcting inclination of the model data which has undergone said height correction, wherein the amount for horizontal displacement of each cross section of the model body portion is computed, in order to align the inclination of the model body portion with that of the customer's body portion, g. adjusting cross section at the lower end of the model body portion which has undergone said correction for inclination, wherein the amount of horizontal displacement for each point on the contour of cross section at the lower extremity of the model body portion is computed in order to align the cross section of the model data with that of the customer's data, h. adjusting cross section at the upper end or the model body portion which has undergone said correction for inclination, wherein the amount of horizontal displacement for each point on the contour of cross section at the upper extremity of the model body portion is computed, in order to align the cross section of the model data with that of the customer's data, i. adjusting cross sections at intermediate heights between the lower and upper ends of the model body portion which has undergone said correction for inclination, wherein the amount of horizontal displacement for each point on the contour of each cross section between the lower and upper ends of the model body portion is computed by proportionally distributing the horizontal displacements at the lower and upper ends of the model body portion found in steps g, and h, respectively, by the distance of the cross section from the lower and upper ends of the body portion, j. correcting for continuity at the lower and upper ends of the body portion with adjacent parts of the customer's body, wherein the amount of horizontal displacement for each point on the contour of cross section at the lower and upper ends of the body portion and at intermediate heights in the vicinity of the ends is computed, in order to attain a smooth transition from the body portion to adjust parts, k. making a pattern from the model data which has undergone said correcting for continuity, l. cutting cloth using said pattern, and m. sewing said cut cloth together.

2. A method of manufacturing a foundation garment of claim 1, further including simulating and displaying, using the model data which has undergone said process of correction for continuity, the worn state of the foundation garment.

3. A method of manufacturing foundation garment of claim 1 or 2, wherein the foundation garment is a brassiere.

4. A method of manufacturing foundation garment of claim 1 or 2, wherein the foundation garment is a bodysuit.

5. A method of manufacturing foundation garment of claim 1 or 2, wherein said measurement of body surface positions is done without contact with body surface.

* * * * *